US005923263A

United States Patent [19]

Rodriguez

[11] Patent Number: 5,923,263

[45] Date of Patent: Jul. 13, 1999

[54] DRIVER SAFETY AND SWIMMING POOL SAFETY DEVICE

[76] Inventor: Luis G. Rodriguez, 104-11 39th Ave., Corona, N.Y. 11368

[21] Appl. No.: 08/941,332

[22] Filed: Sep. 30, 1997

[51] Int. Cl.[6] ..... G08B 21/00

[52] U.S. Cl. ..... 340/689.1; 340/575; 340/573.1; 340/573.4; 200/61.51; 200/61.52

[58] Field of Search ..... 340/575, 686, 340/687, 689, 690, 506, 669, 670, 671, 693, 568, 440, 573, 686.1, 573.1, 573.4; 200/61.52, 61.93, 61.45 R, 61.51; 33/366.13, 365

[56] References Cited

U.S. PATENT DOCUMENTS

| | | | |
|---|---|---|---|
| 2,713,159 | 7/1955 | Morrison | 340/575 |
| 2,754,497 | 7/1956 | Wolpert | 340/575 |
| 2,794,084 | 5/1957 | Segoni | 340/689 |
| 3,076,186 | 1/1963 | Greene | 340/689 |
| 3,208,062 | 9/1965 | Gregory | 340/689 |
| 3,617,664 | 11/1971 | Telrault | 200/61.51 |
| 3,906,478 | 9/1975 | Smey | 340/575 |
| 3,947,815 | 3/1976 | Muncheryan | 340/575 |
| 3,953,831 | 4/1976 | Estrada | 340/575 |
| 4,272,764 | 6/1981 | Herr et al. | 340/575 |
| 4,284,983 | 8/1981 | Lent | 340/568 |
| 4,775,854 | 10/1988 | Cottrell | 340/566 |
| 4,875,030 | 10/1989 | Chiu | 340/575 |
| 5,402,109 | 3/1995 | Mannik | 340/575 |
| 5,522,092 | 6/1996 | Streb et al. | 2/209.13 |

*Primary Examiner*—Jeffery A. Hofsass
*Assistant Examiner*—Benjamin C. Lee
*Attorney, Agent, or Firm*—Steven Horowitz

[57] ABSTRACT

Versatile safety device that detects tilting usable in combination with a hat for driver alertness or in combination with a floatation device for swimming pool safety. Device is composed primarily of two lightweight metallic cups resting on a generally flat base that complete an electric circuit when the device is tilted at least to a certain adjustable angle either because (i) a driver's head is tilted due to drowsiness or (ii) because of waves as device supportably rests on water surface. Tilting of device causes a spherical metallic object to roll from the apex of the inner cup along the side of inner cup toward the edge of the inner cup and thereby touch the outer cup while simultaneously remaining touching the inner cup. Inner metallic cup is upright cone. Outer cup is upside down metallic cover surrounding inner cup on all sides except bottom where flat base appears. Standard lightweight battery, buzzer, wires are used for circuit. When circuit is completed buzzer sounds. In certain embodiments, the angle of inner cup to flat base is adjustable because inner cup is made of malleable metal having pleats running along cone surface from apex to top. Accordingly, degree of driver drowsiness necessary to trigger alarm can be adjusted. As swimming pool safety device in combination with a floatation device on water surface, device can detect motion caused by waves due to a child falling into the swimming pool or an intruder.

17 Claims, 3 Drawing Sheets

DRIVER SAFETY AND SWIMMING POOL SAFETY DEVICE

The present invention is a versatile safety device that operates by detecting tilting. It is particularly useful (i) as a driver alertness devices worn by the driver on headgear that wakes the driver up through noise if the driver's head tilts from drowsiness or sleepiness and (ii) as a swimming pool safety device that detects waves caused by a child or an intruder entering an otherwise inactive swimming pool.

Operators of cars, trucks, airplanes or the like can lose control of their vehicle when the driver becomes drowsy or sleepy. This can cause serious accidents and at worst fatalities. This is particularly serious on long trips. Also, drivers may fail to acknowledge their drowsy state for a number of reasons.

Known devices that have addressed this problem tend to fall into either of two either categories: devices that monitor the position of the driver's head in order to produce an alarm when the driver's head becomes tilted from drowsiness and devices that are designed to monitor whether the eyelids close. The latter type is usually mounted on eyewear and suffer from the drawback that eyewear is laden with additional weight to which the user is very sensitive and that the different contours of people's faces may not be suited to wearing such glasses. The former types are instead usually mounted on headgear. The present invention is an improvement on devices of the former type that have tried to address this problem of vehicle operator sleepiness. Most devices of the former type involve mercury switches.

For example, U.S. Pat. No. 2,754,497 to Wolpert, U.S. Pat. No. 5,522,092 to Streb, U.S. Pat. No. 3,076,186 to Greene, U.S. Pat. No. 2,713,159 to Morrison, U.S. Pat. No. 4,272,764 to Herr et al., U.S. Pat. No. 3,208,062 to Gregory and U.S. Pat. No. 3,996,478 to Smey all contain mercury tilt switches connected to headgear or eyewear. U.S. Pat. No. 3,953,831 to Estrada also contains a mercury switch on eyewear although the device also is limited in that it requires connection to a cigarette lighter receptacle of a vehicle.

The problem with all of these devices is that mercury is a poisonous substance when ingested or even exposed to the skin. Drivers are by definition at risk of collision during an accident. It is a concern to drivers that there is a risk, however, small, that the liquid mercury of a mercury switch could somehow be released in the event of an accident due to the collision of the vehicle and that the driver could be further injured from the toxic mercury. Whether due to the psychological discomfort from the thought of being exposed to a toxic substance or the actual danger, it is preferable to avoid the use of mercury so close to the head and face for long periods of time.

Another disadvantage of these devices is that none of them are adjustable in terms of the degree of sleepiness needed to trigger the alarm.

What is needed is a device for keeping drivers alert that does not employ a mercury switch near the head or any other toxic material yet is lightweight, strong and durable yet simple in construction and manufacture, capable of being made in various sizes for men and women, effective and adjustable in that it can be adjusted as to the degree of sleepiness that triggers the alarm.

Another danger requiring a safety device is in connection with swimming pools. It has long been recognized that there can be a danger to young children from having an in-ground swimming pool or a stand alone swimming pool on one's property. Many parents who would otherwise build or buy such swimming pools do not do so out of fear that when they are not watching one of their children could accidentally drown in the pool. There of course also exists a serious danger to older individuals from drowning in an accident. There has been a well recognized need to have safety mechanisms that ensure that swimming pools are safe.

Accordingly, there has long been a need for a swimming pool safety device that can prevent individuals, especially children, from accidentally entering the area of and drowning in a swimming pool. In addition, there is a need to ensure that intruders do not use a swimming pool located on one's private property. It is also essential for the maintenance of the pool that unwanted intruders be thwarted from using the pool. At present, most pool owners use fences to attempt to deter intrusion. This is inadequate since children and intruders can and will climb over the fences, thereby gaining easy access to the pool.

The present invention addresses all these safety and protection needs by providing a versatile safety device that detects tilting. This is useful for driver alertness, wherein the device of the present invention can be used in combination with a hat. This is also useful for swimming pool safety protecting against accidental or unwanted use of an in-ground swimming pool, wherein the device detects tilting caused by swimming pool waves and would be used in combination with a swimming pool floatation device.

OBJECTS AND ADVANTAGES

The following important objects and advantages of the present invention are:

(a) to provide a driver alertness device that is safe to use and does not employ mercury switches, (b) to provide a driver alertness device that is lightweight, (c) to provide a driver alertness device that is strong and durable, (d) to provide a driver alertness device that is simple in construction and manufacture, (e) to provide a driver alertness device that is capable of being made in various sizes for men and women, (f) to provide a driver alertness device that is highly effective in operation, (g) to provide a driver alertness device that can be adjusted as to the degree of sleepiness that triggers the alarm, (h) to provide a versatile safety device that can be used for driver alertness and for swimming pool safety while maintaining all of the above advantages, and (i) to provide a swimming pool safety device that can detect waves caused by children entering a pool or intruders, wherein such waves cause the device to tilt and thereby set off an alarm.

DETAILED DESCRIPTION OF THE DRAWINGS

Figure 1:
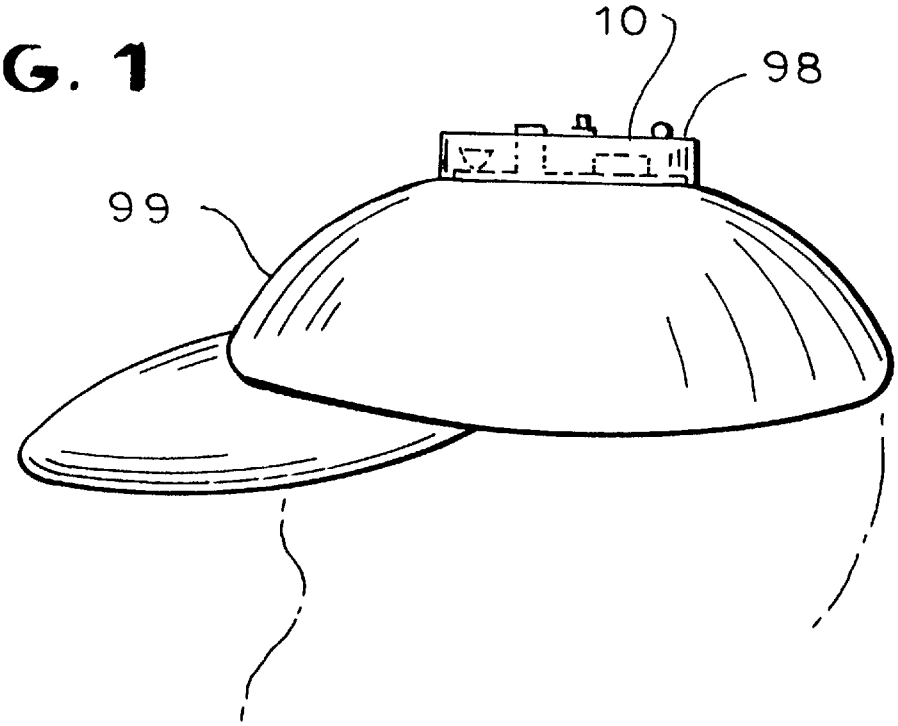
FIG. 1 is a side elevational view of the device of the present invention used in combination with a hat.
Figure 2:
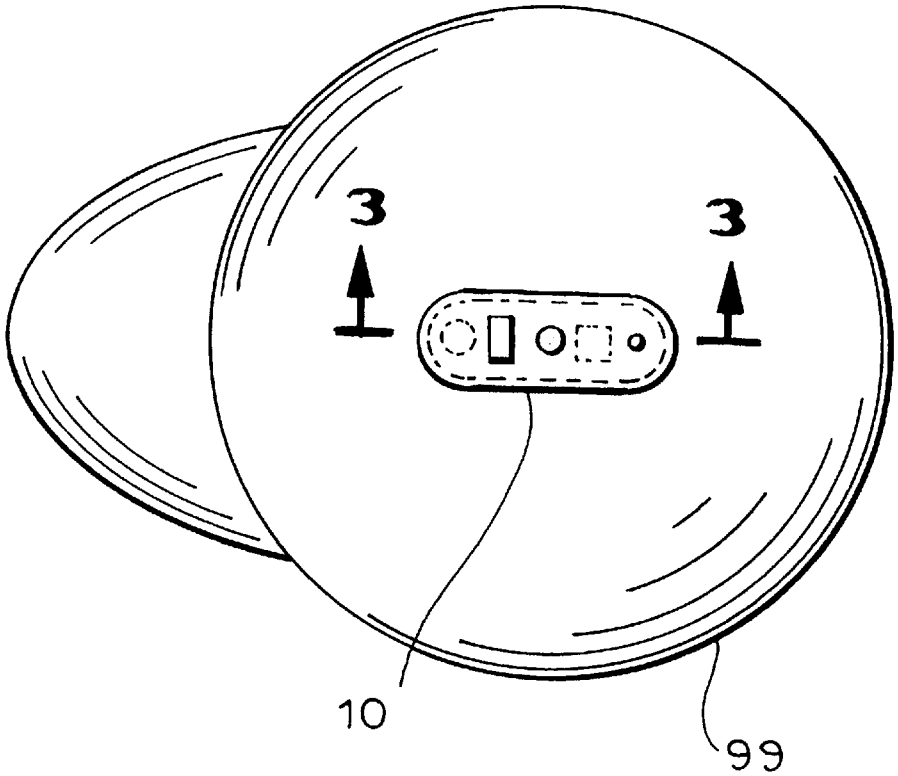
FIG. 2 is a top plan view of the device of the present invention used in combination with a hat.

Referring to FIGS. 1–6, it can be seen that the device 10 is primarily used in combination with a hat 99 and comprises several components, all lightweight, that are arranged in a series circuit. First of all, there is a switch 20 made of an inner cup 23, an outer cup 27 and a metal ball 29. There is also a buzzer 30 for sounding an alarm, a battery 34 and electric wires 36 connected thereto and forming a circuit in series with the buzzer 30. In addition, also connected in series is a light 25 mounted to the base 40 that goes on when the circuit is completed. There is also an on-off switch 88 connected in series so that the device in tilted position will not make noise. These components are mounted on a substantially flat base 40 and the flat base is securely attached to the hat 99, either on the brim of the hat 99 or more likely on the top of the hat 99. Any standard cover 98 for the device 10 to prevent components thereof from moving around and becoming disengaged from the circuit and from one another is satisfactory.

Figure 3:
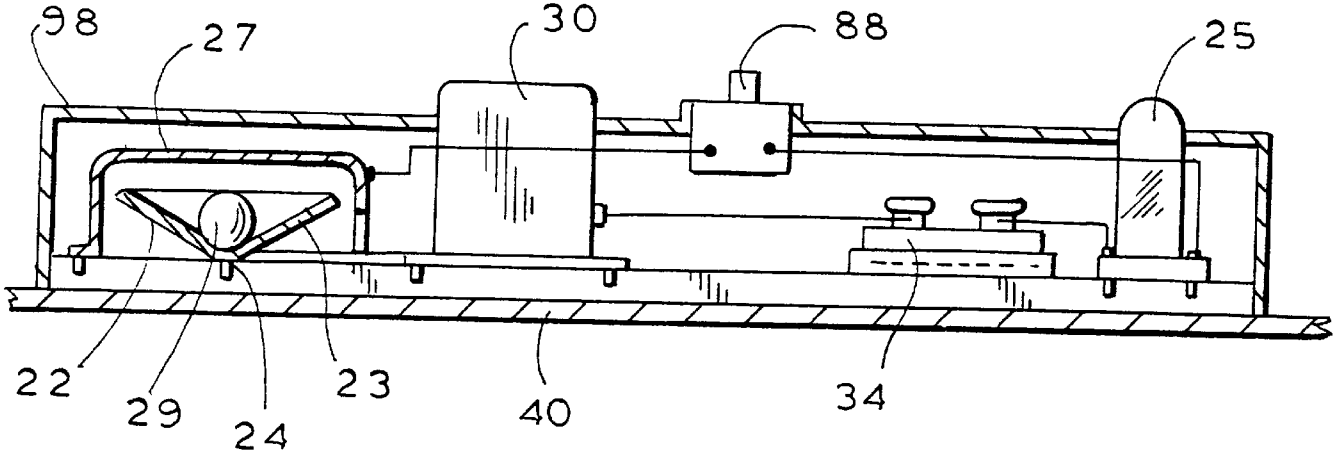
FIG. 3 is a cross-sectional view taken along line 3—3 of FIG. 2.
Figure 4:
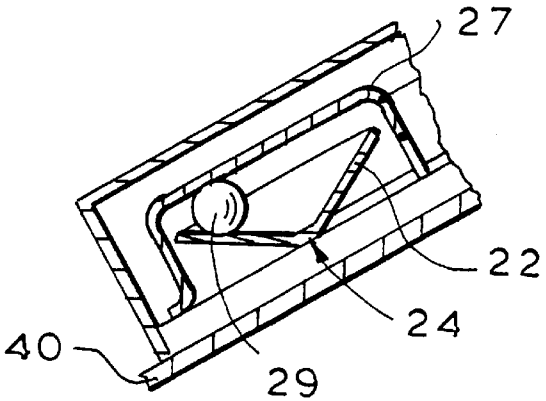
FIG. 4 is a fragmentary partial view of FIG. 3 showing the device of the present invention in tilted position.

As best seen in FIGS. 3–4, the inner cup 23 is lightweight and metallic, such as lightweight aluminum, and shaped as a cone whose apex 24 is mounted on the flat base 40 and whose sides 22 form angle "x" with flat base 40. The outer cup 27 is also lightweight and metallic and is in the shape of a hollow uncovered upside down cubic box facing down on the flat base 40. The outer cup 27 thereby surrounds the inner cup 23 on all sides (except for the bottom, which is the flat base 40) with an air gap between them. The air gap must be smaller, when measured from any part of sides 22 of the inner cup 23 to the outer cup 27, than the diameter of the metal ball 29. The lightweight metal ball 29 is situated at the apex 24 of the inner cup 23 when the device 10 is upright and therefore no noise is made. The metal ball 29 is capable of rolling to an edge 25 of the inner cup 23 so that it simultaneously touches the inner cup 23 and the outer cup 27 thereby completing the circuit and, if the "on-off" switch is in the "on" position, sounding the alarm.

The buzzer 30 is a standard buzzer known in the art to make a continuous buzzing noise when connected to an electric circuit. In addition, buzzer 30 could be in the form, well known in the art, that vibrates when a mode switch (not shown) is pushed to put the buzzer 30 into vibrating mode. This would be ideal for individuals who cannot hear.

Figure 6:
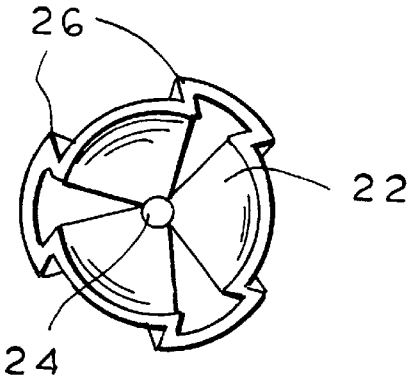
FIG. 6 is a top plan view of an embodiment of the inner cup of the device of the present invention showing an expandable structure.
Figure 5:
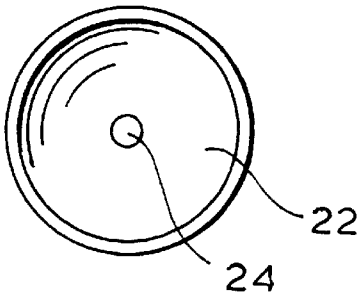
FIG. 5 is a top plan view of the inner cup of the device of the present invention.

As seen in FIG. 6, as an option, device 10 also has means to adjust the angle at which the device 10 need be tilted for the buzzer 30 to sound an alarm. Pleats 26 or folds 26 running lengthwise along sides 22 of inner cup 23 permit manual expansion of inner cup 23 by opening the pleats 26 or folds 26 and hence reduction of the angle "x" that sides 22 of inner cup 23 make with generally flat base 40 in proportion to such opening and expansion. In this way, the degree of desired sleepiness necessary to trigger alarm can be precalibrated and set and later adjusted. That is, in order to adjust the angle at which the device need be tilted for the alarm to be sounded, the angle between the base 40 and the sides 22 of inner cup 23 can be set by calibrating the amount that folds 26 should be opened to expand sides 22 of inner cup 23. For the embodiment wherein the device 10 of the present invention is used in combination with a hat, it is believed that for the average person an angle of approximately 15–30 degrees is the ideal angle "x" to be set for the tilt of the driver's head that would trigger the alarm and the device should be set as such.

When a driver of a vehicle wears a hat to which is attached the device of the present invention, the driver can adjust the a pleats or folds 26 to determine how much head tilting, and in effect how much drowsiness, he wishes to trigger the alarm and the light which goes on simultaneous with the alarm. When the driver's head tilts from drowsiness, the lightweight metallic ball 29 rolls along sides 22 of inner cup 23 to make contact with outer cup 27 without losing contact with inner cup 23 thereby completing the electrical circuit provided "on-off" switch 88 is "on".

Use for Swimming Pool Safety

Figure 7:
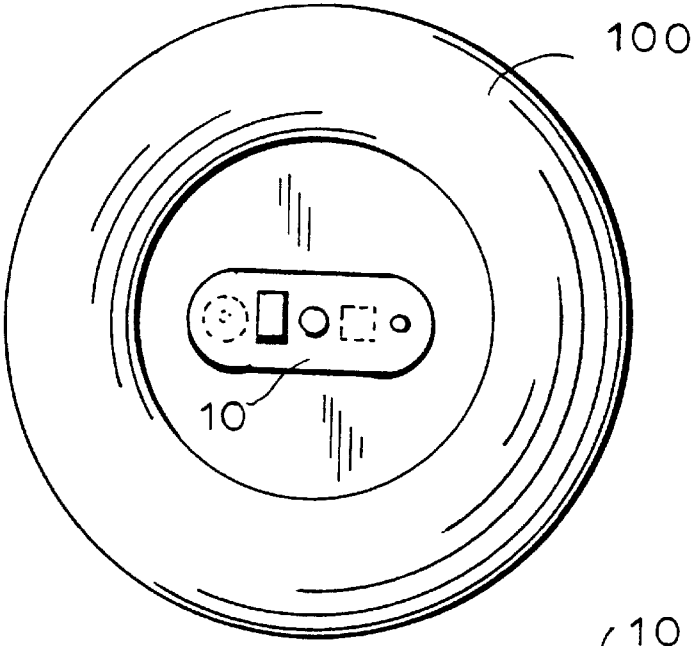
FIG. 7 is a top plan view of the device of the present invention used in combination with a floatation device on a swimming pool water surface.
Figure 8:
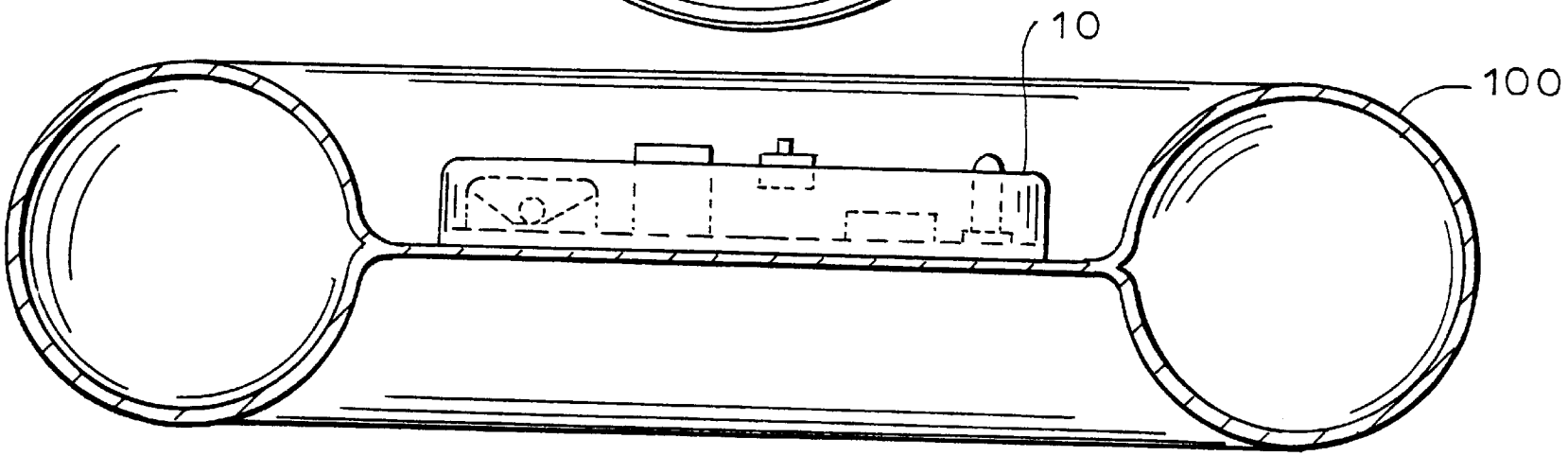
FIG. 8 is a cross sectional view taken along line 8—8 of FIG. 7.

As seen in FIGS. 7 and 8, another important use for the device 10 of the present invention is in combination with a swimming pool floatation device wherein device 10 detects the existence of waves generated in an otherwise inactive swimming pool by someone falling into the pool or by an intruder. That is, if a child falls into or begins to go into the swimming pool—whether an in-ground swimming pool or a stand alone swimming pool—when it is supposed to inactive, or if an intruder goes into the swimming pool, the child's motion or the intruder's motion will generate waves. If the tilt device 10 of the present invention is placed on top of any simple floatation device 100 well known in the art, as seen in FIGS. 7 and 8, the waves (not shown) caused by the child or intruder will cause the device 10 of the present invention to be tilted. As a result of the tilt caused by the waves, the lightweight metallic ball 29 of device 10 will roll along sides 22 of inner cup 23 to make contact with outer cup 27 without losing contact with inner cup 23 and will thereby complete the electrical circuit provided "on-off" switch 88 is "on". An alarm will sounds alerting the parents or swimming pool owner to the child's or intruder's actions in entering the pool.

It is contemplated by the present invention that when used in connection with swimming pool safety, device 10 should be adjusted or made so that the angle at which the device 10 need be tilted for the buzzer 30 to sound an alarm is small enough so that the device 10 is sufficiently sensitive for the alarm to be sounded whenever moderate sized waves in the pool are generated. Although the present invention is by no means limited to any particular angle "x", it is believed that an angle of approximately 10 degrees may be ideal for the swimming pool use of the present invention, although the desired angle will vary with the individual user. Furthermore, the floatation device 100 depicted in FIGS. 7–8 is only illustrative. It is contemplated by the present invention that any floatation device would be suitably used in combination with the present invention so long as it floats and can support the device of the present invention without it falling off. In addition, the device 10 can be made watertight when used in combination with a floatation device by covering it with a very thin plastic that allows sound to go through such as the material that is used to cover food for storage (sometimes sold under the trademark "Saran Wrap"). The plastic waterproofing can be attached in standard ways such as by being glued under the standard cover 98 of device 10.

It is to be understood that while the apparatus of this invention have been described and illustrated in detail, the above-described embodiments are simply illustrative of the principles of the invention. It is to be understood also that various other modifications and changes may be devised by those skilled in the art which will embody the principles of the invention and fall within the spirit and scope thereof. It is not desired to limit the invention to the exact construction and operation shown and described. The spirit and scope of this invention are limited only by the spirit and scope of the following claims.

What is claimed is:

1. A safety device for detecting tilting for use in combination with a hat or a swimming pool floatation device comprising:

a switch made of an inner cup, an outer cup and a metal ball, a buzzer for sounding an alarm, a battery and electric wires connected thereto and forming a circuit in series with said buzzer, a flat base for mounting thereon the switch, the buzzer, the battery, said flat base securely attached to the hat, said inner cup being metallic and shaped as a cone whose apex abuts and is mounted on the flat base, said outer cup being metallic and shaped as a hollow uncovered upside down box facing the flat base and surrounding said inner cup on all sides with an air gap between them smaller, when measured from a side of the inner cup to the outer cup, than the diameter of the metal ball, said metal ball situated at the apex of said inner cup when the device is upright and off and capable of rolling to an edge of said inner cup when the device is tilted so that the metal ball simultaneously touches the inner cup and the outer cup thereby completing the circuit and sounding the alarm.

2. A sleep inhibiting device for keeping drivers of vehicles alert for use in combination with a hat comprising:

a switch made of an inner cup, an outer cup and a metal ball, a buzzer for sounding an alarm, a battery and electric wires connected thereto and forming a circuit in series with said buzzer, a flat base for mounting thereon the switch, the buzzer, the battery, said flat base securely attached to the hat, said inner cup being metallic and shaped as a cone whose apex abuts and is mounted on the flat base, said outer cup being metallic and shaped as a hollow uncovered upside down box facing the flat base and surrounding said inner cup on all sides with an air gap between them smaller, when measured from a side of the inner cup to the outer cup, than the diameter of the metal ball, said metal ball situated at the apex of said inner cup when the device is upright and off and capable of rolling to an edge of said inner cup when the device is tilted so that the metal ball simultaneously touches the inner cup and the outer cup thereby completing the circuit and sounding the alarm.

3. The device of claim 2, wherein the device has means to adjust the angle at which the device need be tilted in order for the alarm to be sounded.

4. The device of claim 2, wherein in order to adjust the angle between the sides of the cone and the flat base and thereby adjust the angle at which the device need be tilted for the alarm to be sounded, the inner cup has pleats running along the sides of the cone which when opened reduce the angle between the sides of the cone and the flat base in an amount proportionate to the degree the pleats are opened.

5. The device of claim 2, wherein the base is attached to a top part of the hat by means of brackets.

6. The device of claim 2, wherein the base is attached to a brim of the hat by means of brackets and the angle sides of the inner cup and the base is approximately between 15 and 30 degrees.

7. An improvement in a sleep inhibiting device for keeping drivers of vehicles alert for use in combination with a hat wherein a buzzer on a base connected to an electric circuit signals an alarm when the device is tilted, the improvement comprising:

a switch made of an inner cup, an outer cup and a metal ball, said inner cup being metallic and shaped as a cone whose apex abuts and is mounted on the base, said outer cup being metallic and shaped as a hollow uncovered upside down box facing the base and surrounding said inner cup on all sides with an air gap between them smaller, when measured from a side of the inner cup to the outer cup, than the diameter of the metal ball, said metal ball situated at the apex of said inner cup when the device is upright and off and capable of rolling to an edge of said inner cup so that it simultaneously touches the inner cup and the outer cup thereby completing the circuit.

8. The device of claim 7, wherein the device has means to adjust the angle at which the device need be tilted in order for the alarm to be sounded.

9. The device of claim 7, wherein in order to adjust the angle between the sides of the cone and the base and thereby adjust the angle at which the device need be tilted for the alarm to be sounded, the inner cup has pleats running along the sides of the cone which when opened reduce the angle between the sides of the cone and the base in an amount proportionate to the degree the pleats are opened.

10. The device of claim 7, wherein the base is attached to a top part of the hat by means of brackets.

11. The device of claim 7, wherein the base is attached to a brim of the hat by means of brackets and the angle sides of the inner cup and the base is approximately between 15 and 30 degrees.

12. A swimming pool safety device for detecting waves caused by unwanted use of the swimming pool for use in combination with a floatation device in the pool, comprising:

a switch made of an inner cup, an outer cup and a metal ball, a buzzer for sounding an alarm, a battery and electric wires connected thereto and forming a circuit in series with said buzzer, a flat base for mounting thereon the switch, the buzzer, the battery, said flat base securely attached to the floatation device, said inner cup being metallic and shaped as a cone whose apex abuts and is mounted on the flat base, said outer cup being metallic and shaped as a hollow uncovered upside down box facing the flat base and surrounding said inner cup on all sides with an air gap between them smaller, when measured from a side of the inner cup to the outer cup, than the diameter of the-metal ball, said metal ball situated at the apex of said inner cup when the device is upright and off and capable of rolling to an edge of said inner cup when the device is tilted by a wave so that the metal ball simultaneously touches the inner cup and the outer cup thereby completing the circuit and sounding the alarm.

13. The device of claim 12, wherein the device has means to adjust the angle at which the device need be tilted in order for the alarm to be sounded.

14. The device of claim 12, wherein in order to adjust the angle between the sides of the cone and the flat base and thereby adjust the angle at which the device need be tilted for the alarm to be sounded, the inner cup has pleats running along the sides of the cone which when opened reduce the angle between the sides of the cone and the flat base in an amount proportionate to the degree the pleats are opened.

15. The device of claim 12, wherein the angle between the base and the sides of the inner cup is approximately 10 degrees.

16. A method of preventing swimming pool accidents and intrusions, which comprises the steps of placing a floatation device on a surface of water in the swimming pool and then placing a tilt device on the floatation device so that it is securely supported thereon, said tilt device comprising a switch made of an inner cup, an outer cup and a metal ball, a buzzer for sounding an alarm, a battery and electric wires connected thereto and forming a circuit in series with said buzzer, a flat base for mounting thereon the switch, the buzzer, the battery, said flat base securely attached to the floatation device, said inner cup being metallic and shaped as a cone whose apex abuts and is mounted on the flat base, said outer cup being metallic and shaped as a hollow uncovered upside down box facing the flat base and surrounding said inner cup on all sides with an air gap between them smaller, when measured from a side of the inner cup to the outer cup, than the diameter of the metal ball, said metal ball situated at the apex of said inner cup when the device is upright and off and capable of rolling to an edge of said inner cup when the device is tilted by a wave so that the metal ball simultaneously touches the inner cup and the outer cup thereby completing the circuit and sounding the alarm.

17. The method of claim 16, wherein the tilt device has means to adjust the angle at which the tilt device need be tilted in order for the alarm to be sounded.

* * * * *